US006718564B2

(12) United States Patent
Duncan et al.

(10) Patent No.: US 6,718,564 B2
(45) Date of Patent: Apr. 13, 2004

(54) ADAPTER FOR CONVERTING A FLUSHOMETER VALVE TO A WATER SOURCE

(76) Inventors: Jack T. Duncan, 202 E. Bloomfield, Royal Oak, MI (US) 48073; Jacqueline R. Johnson, 3365 Glen Iris Dr., Commerce, MI (US) 48382

( * ) Notice: Subject to any disclaimer, the term of this patent is extended or adjusted under 35 U.S.C. 154(b) by 0 days.

(21) Appl. No.: 10/191,829

(22) Filed: Jul. 9, 2002

(65) Prior Publication Data

US 2004/0006817 A1 Jan. 15, 2004

(51) Int. Cl.[7] ..... E03D 3/00

(52) U.S. Cl. ..... 4/300.2; 4/420.4; 4/443; 4/422

(58) Field of Search ..... 4/300.2, 420–420.5, 4/443–8, 422, 423; 137/615, 616

(56) References Cited

U.S. PATENT DOCUMENTS

| | | | | | |
|---|---|---|---|---|---|
| 2,700,773 | A | | 2/1955 | Colendar | 4/300.2 |
| 2,703,408 | A | | 3/1955 | Gray | 4/300.2 |
| 2,956,285 | A | | 10/1960 | Jewell | 4/300.2 |
| 3,629,872 | A | | 12/1971 | Parkison | 4/300.2 |
| 3,646,617 | A | | 3/1972 | Heald | 4/300.2 |
| 3,855,640 | A | | 12/1974 | Filliung et al. | 4/300.2 |
| 3,964,108 | A | | 6/1976 | Lissau | 4/300.2 |
| 5,063,619 | A | * | 11/1991 | Ross et al. | 4/443 |
| 5,199,115 | A | | 4/1993 | Whiteside | 4/300.2 |
| 6,035,458 | A | * | 3/2000 | Tarzia | 4/443 |

* cited by examiner

*Primary Examiner*—Henry Bennett
*Assistant Examiner*—Amanda Flynn
(74) *Attorney, Agent, or Firm*—Harness, Dickey & Pierce, PLC

(57) ABSTRACT

An apparatus for providing a secondary source of water upstream of a standard flushometer-type valve. The adapter comprises a water inlet, a primary outlet for supplying water to the flush valve and respectively to the toilet, and a secondary outlet for providing a source of water which may be used to rinse out bed pans in the vicinity of the toilet. The water flow to the secondary outlet is independent of that to the primary outlet, providing for less waste of water during use of the secondary source.

8 Claims, 2 Drawing Sheets

ADAPTER FOR CONVERTING A FLUSHOMETER VALVE TO A WATER SOURCE

FIELD OF THE INVENTION

The present invention relates to an apparatus for diverting water from a conventional plumbing fixture. More specifically this invention relates to an apparatus for diverting water from a plumbing fixture up-stream of a flushometer-type flush valve.

BACKGROUND OF THE INVENTION

Secondary water source adapters, such as hospital bed pan rinsing apparatuses have been around for a long time. Their purpose evolved from several uses, including the need to sanitarily rinse out the inside of a bed pan by allowing the user to have at least one hand free for manipulating the bed pan under a stream of flowing water.

Traditionally they have been comprised of a diversion from a wall mounted flush pipe generally used to supply water to a toilet bowl, by use of a manually operated flush valve. Such valves have been manufactured for many years by a number of companies, including the SLOAN VALVE COMPANY of Franklin Park, Ill., and are frequently referred to as "Sloan" or "Sloan-type" valves. The present invention, however, is not limited to use with only said "Sloan" valves, but instead will find wide and varied application with virtually all types of flushometer-type valves. Also, while the present invention is depicted in operative association with a flushometer-type valve on a conventional toilet, the principals of the invention may be used in conjunction with urinals, clinical sinks, detox drains an related appliances.

Several prior art patents teach of a water diversion apparatus implemented inline with the flush valve. U.S. Pat. No. 3,629,872 issued to Parkison teaches of a water diversion apparatus located down stream of a flushometer-type flush valve for partially diverting the water flow to the bowl during flushing to a pivotal armature used to rinse out a bed pan into the toilet.

U.S. Pat. No. 3,855,640 issued to Filliung et al. further teaches of a similar water diversion apparatus located down stream of the utilized flush valve. Both of these aforementioned inventions require the user to manually flush the toilet valve by means of the flush valve to initiate water flow to the diversion apparatus. This results in water flowing to both the toilet and the water diversion armature simultaneously, causing unnecessary waste.

U.S. Pat. No. 5,199,115 issued to Whiteside, teaching an improved seal to U.S. Pat. No. 3,855,640 above, further shows a water diversion apparatus which completely shuts off the flow of water to the toilet when the spray armature is pivoted down for use. While this minimizes the amount water used to rinse out a bed pan, there is still some water wasted from the time the user operates the manual flush valve, to the time the armature is brought down to use. Furthermore, if additional water is required above and beyond a single flush, the flush-valve must be manually operated again as needed, limiting the amount of water used to the volume of a single flush.

The present invention overcomes these disadvantages of the prior art in creating a diversion valve to be implemented upstream of the flushometer-type valve allowing a steady, continuous flow of water to the bed pan rinsing apparatus and limiting the amount of water used to only the amount so required. The present invention is intended, but is not limited to be utilized with all standard-rough plumbing specifications, eliminating the need to modify the existing water supplies. Furthermore, the present invention can be used to supply water for a variety of needs not limited to bed pan rinsing, for example, providing an auxiliary bidet seat.

SUMMARY OF THE INVENTION

It is therefore an object of the present invention to provide for a water diversion adapter to be implemented in conjunction with a flushometer-type valve, creating a secondary source of water to be utilized in a variety of ways but not limited to the rinsing out of bed pans.

It is a further object of the present invention to provide for a secondary source of water that can be utilized without the need to manually operate the flushometer valve of the toilet.

It is another object of the present invention to provide for less water use by diverting the flow of water completely from the toilet flush valve to the secondary source during use of the rinsing apparatus.

A more specific object of the present invention is to provide for a secondary source of water implemented upstream of a flushometer-type valve, diverting water away from the flush valve to a rinsing apparatus, for cleaning bed pans, adapting to a bidet seat, or serving any other need for a water source.

It is another object of the present invention to provide for a secondary source of water which may be implemented into any existing plumbing fixture having the standard-rough plumbing specification.

It is also an object of the present invention to provide for a secondary source of water having a constant flow and pressure not affected by a flushometer valve of the toilet or other appliance upon which the water diversion adapter is implemented.

The foregoing objects are accomplished in the present invention by providing for a secondary source of water upstream of a toilet flush valve. The adapter comprises a water inlet, a primary outlet for supplying water to the flush valve and toilet, and a secondary outlet for providing a source of water which may be used to rinse out bed pans in the vicinity of the toilet. The water flow to the secondary outlet is independent of that to the primary outlet, providing for less waste of water during use of the secondary source. The secondary water source may be implemented into any existing standard-rough plumbing layout.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
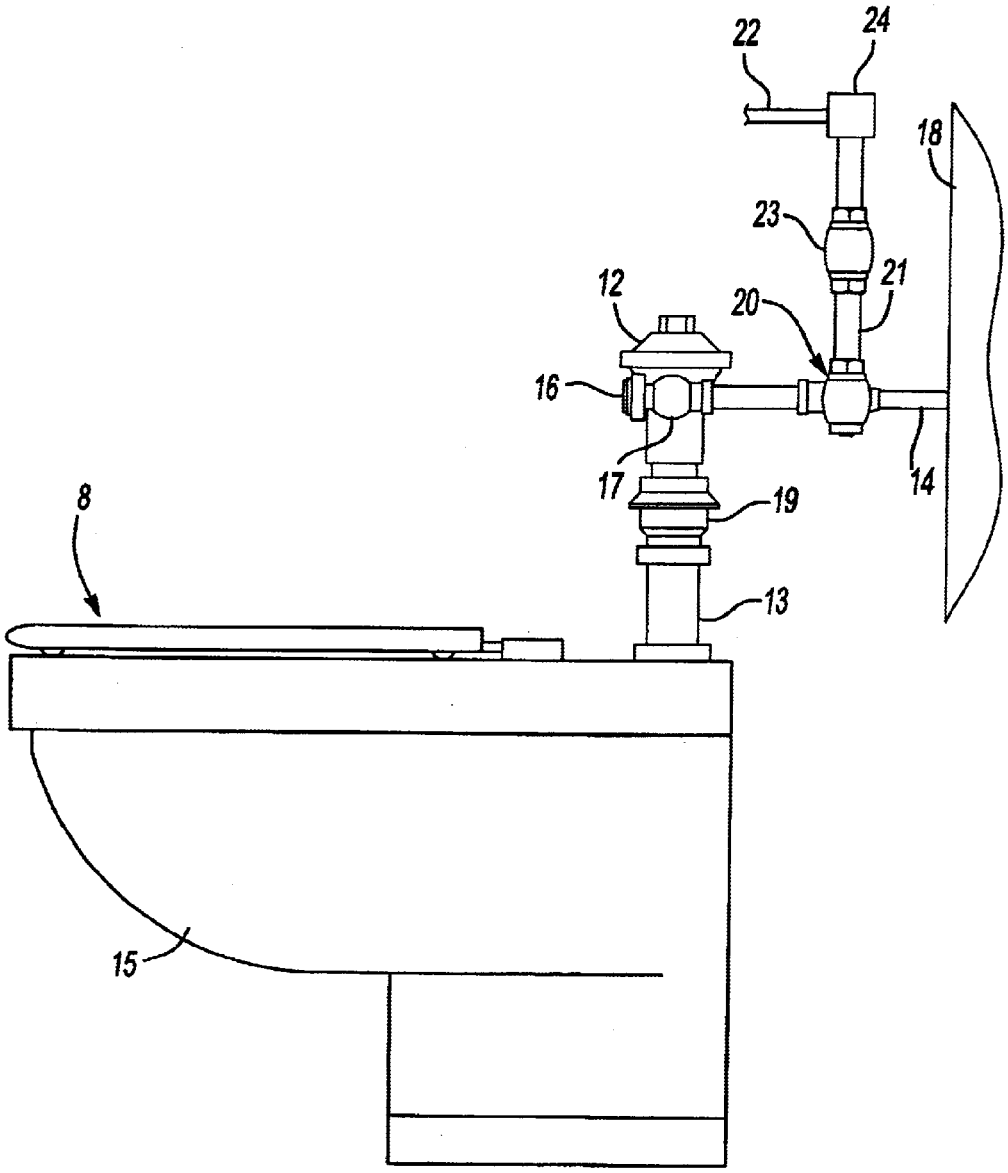
FIG. 1 is a side view of the water source adapter as installed on a flush valve operated toilet.

Referring to FIG. 1, a conventional flush style toilet 8 comprising a flush valve 12 such as a flushometer-type valve, is connected to the toilet bowl 15 through a flush pipe 13. The valve 12 is further connected to a water source through an inlet pipe 14 having a control stop 17, providing for the flushing of the toilet 8 whenever the valve button 16 is actuated. The adapter valve of the present invention, generally at 20 is interposed in the inlet pipe 14 between the control stop 17 and the wall 18 through which the water source originates. A check valve 19 is interposed within the flush pipe 13 between the toilet bowl 15 and the flush valve 12 to prevent back siphonage. The parts enumerated thus far with exception of the adapter 20 are of common and well known construction.

The adapter for converting the flush style toilet 8 to a secondary source of water is further connected to a auxiliary pipe 21 for possibly attaching a hose 22 thereto enabling a user to rinse out bed pans. Interposed in line of the auxiliary pipe 21 is a gate valve 23 and a vacuum breaker 24 to control the flow of the secondary source of water and to prevent leakage. The hose 22 can be attached to an assortment of spray nozzles, rinsing apparatuses, adapters, or remain a water supply pipe to best suit the needs of the desired application.

Figure 2:
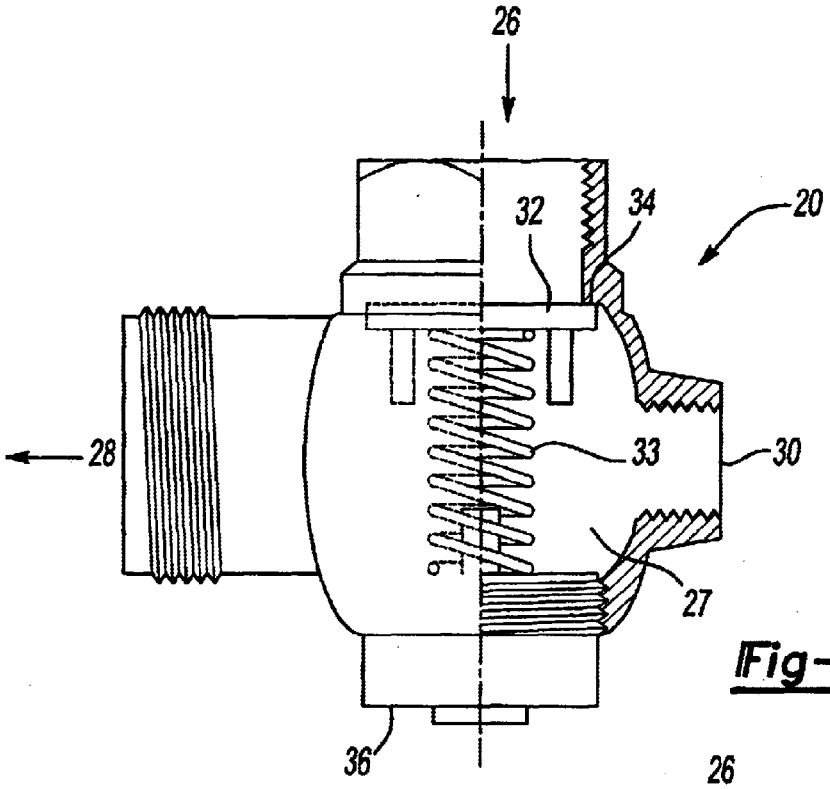
FIG. 2 is a partial cross-sectional side view of the preferred embodiment of the water source adapter.
Figure 3:
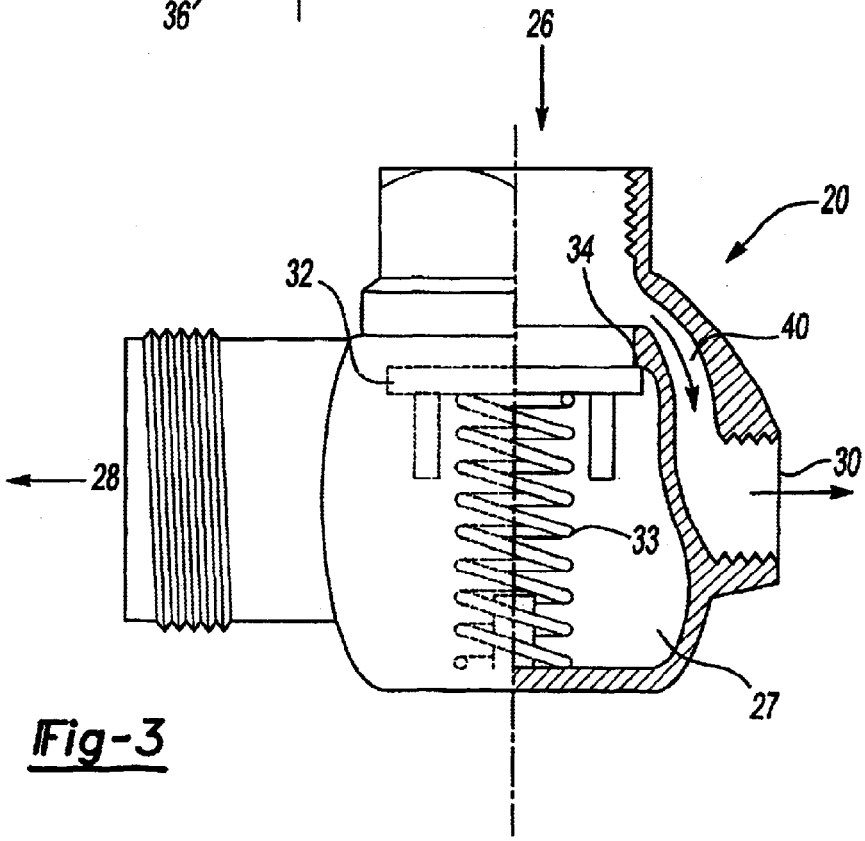
FIG. 3 is a partial cross-sectional side view of an alternative embodiment of the present invention.

Referring now to FIGS. 2 and 3, there is shown a detailed construction of the diverter adapter valve 20. The valve 20 has a water source inlet 26, a primary outlet 28 connecting to the control stop 17 and flush valve 12, and the secondary outlet 30 for attachment to the auxiliary pipe 21, and hose 22 of the present invention. The adapter comprises an interior chamber 27 within which water flows directly through to either the primary outlet 28 or the secondary outlet 30 when either the flush valve 12 or the vacuum breaker 24 are activated respectively.

Referring specifically to FIG. 2, the preferred embodiment of the present invention is shown generally depicted as 20. Disposed within the interior chamber 27 is a check valve 32 having a valve bonnet 36 and, a spring 33 biasing the valve 32 against a valve seat 34. The primary outlet 28 is of a predetermined inside diameter and is externally threaded for coupling to the pipe 14 leading to the control stop 17. The secondary outlet 30 is of a smaller diameter than the primary outlet 28 and is threaded internally for coupling with the auxiliary pipe 21.

When either the flush valve 12 or gate valve 23 are actuated by the user, the check valve 32 opens, allowing the flow of water to the primary outlet 28 and secondary outlet 30 respectively. Once the flow of water has been shut off to either the primary outlet 28 or the secondary outlet 30, the check valve returns to its closed, seated position.

Referring now to FIG. 3, an alternative embodiment of the present invention is shown. In this embodiment, the valve body comprises a passage 40 within the interior chamber 27, providing a direct source of water from the water source inlet 26 to the secondary outlet 30, bypassing the check valve 32. In this embodiment, constant water pressure is delivered to the secondary outlet 30 and respectively to the auxiliary pipe 21. When the gate valve 23 on the secondary water source is actuated, the user receives a constant water pressure delivered to the auxiliary pipe 21 without any water traveling through the check valve 32 and on through primary outlet 28 to the flush valve 12. This arrangement provides for less water to be consumed during the use of the secondary water source.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An auxiliary water source adapter adapted for use with a flushometer-type appliance valve for creating a water source in close proximity to the appliance comprising:

a housing having an inlet connected to a water source, said water source being a pre-existing rough water source utilized for flushing the toilet;

a primary outlet connected to said appliance toilet flush valve and;

a secondary outlet, connecting to a rinsing apparatus;

a passage between said inlet and said primary and secondary outlets for providing fluid communication from said water source to said rinsing apparatus.

2. The auxiliary water source adapter of claim 1 wherein said adapter is located upstream of said flush valve, providing for a constant supply of water-pressure to said adapter.

3. The auxiliary water source adapter of claim 1 wherein said primary outlet provides a passage means for water to flow to said flush valve from said water source.

4. The auxiliary water source adapter of claim 1 wherein said secondary outlet provides a passage means for water to flow to said rinsing apparatus.

5. The auxiliary water source adapter of claim 1 wherein said rinsing apparatus comprises:

a gate valve;

a vacuum breaker, and;

a water supply pipe.

6. The auxiliary water source adapter of claim 1 wherein said adapter has a check valve biased against a valve seat located within said housing interposed between the passage comprising said inlet and said primary and secondary outlets.

7. The auxiliary water source adapter of claim 1 wherein said adapter has a check valve biased against a valve seat located within said housing interposed between the passage comprising said inlet and said primary outlet, and a bypass providing for the direct flow of water from said inlet to said secondary outlet.

8. An auxiliary water source adapter adapted for use with a flushometer-type appliance valve for creating a water source in close proximity to the appliance comprising:

a housing having an inlet connected to a water source, said water source being a pre-existing rough water source utilized for flushing the toilet;

a primary outlet connected to said appliance toilet flush valve;

a check valve disposed between said inlet and said primary outlet;

a secondary outlet, connecting to a rinsing apparatus, said secondary outlet provides a means for water to flow to said rinsing apparatus, said rinsing apparatus comprising a gate valve, a vacuum breaker, and a water supply pipe;

a passage between said inlet and said primary outlet, said passage providing means for fluid communication of water to flow to said flush valve from said water source; and a passage between said inlet and said secondary outlet, said passage bypassing said check valve for providing fluid communication from said water source to said rinsing apparatus when said gate valve is actuated.

* * * * *

UNITED STATES PATENT AND TRADEMARK OFFICE

CERTIFICATE OF CORRECTION

PATENT NO. : 6,718,564 B2
APPLICATION NO. : 10/191829
DATED : April 13, 2004
INVENTOR(S) : Jack T. Duncan et al.

It is certified that error appears in the above-identified patent and that said Letters Patent is hereby corrected as shown below:

The title page should be deleted and substitute therefor the attached title page.

Col. 3, line 24, delete "having a control stop 17"

Col. 3, lines 27 - 28, delete "between the control stop 17 and the wall 18"

Col. 3, line 49, delete "control stop 17 and"

Col. 3, line 64, delete "leading to the control stop 17"

Signed and Sealed this

Nineteenth Day of January, 2010

David J. Kappos

David J. Kappos
*Director of the United States Patent and Trademark Office*

(12) United States Patent
Duncan et al.

(10) Patent No.: US 6,718,564 B2
(45) Date of Patent: Apr. 13, 2004

(54) ADAPTER FOR CONVERTING A FLUSHOMETER VALVE TO A WATER SOURCE

(76) Inventors: Jack T. Duncan, 202 E. Bloomfield, Royal Oak, MI (US) 48073; Jacqueline R. Johnson, 3365 Glen Iris Dr., Commerce, MI (US) 48382

( * ) Notice: Subject to any disclaimer, the term of this patent is extended or adjusted under 35 U.S.C. 154(b) by 0 days.

(21) Appl. No.: 10/191,829

(22) Filed: Jul. 9, 2002

(65) Prior Publication Data

US 2004/0006817 A1 Jan. 15, 2004

(51) Int. Cl.[7] ..... E03D 3/00

(52) U.S. Cl. ..... 4/300.2; 4/420.4; 4/443; 4/422

(58) Field of Search ..... 4/300.2, 420–420.5, 4/443–8, 422, 423; 137/615, 616

(56) References Cited

U.S. PATENT DOCUMENTS

| | | | | | |
|---|---|---|---|---|---|
| 2,700,773 | A | | 2/1955 | Colendar | 4/300.2 |
| 2,703,408 | A | | 3/1955 | Gray | 4/300.2 |
| 2,956,285 | A | | 10/1960 | Jewell | 4/300.2 |
| 3,629,872 | A | | 12/1971 | Parkison | 4/300.2 |
| 3,646,617 | A | | 3/1972 | Heald | 4/300.2 |
| 3,855,640 | A | | 12/1974 | Filliung et al. | 4/300.2 |
| 3,964,108 | A | | 6/1976 | Lissau | 4/300.2 |
| 5,063,619 | A | * | 11/1991 | Ross et al. | 4/443 |
| 5,199,115 | A | | 4/1993 | Whiteside | 4/300.2 |
| 6,035,458 | A | * | 3/2000 | Tarzia | 4/443 |

* cited by examiner

*Primary Examiner*—Henry Bennett
*Assistant Examiner*—Amanda Flynn
(74) *Attorney, Agent, or Firm*—Harness, Dickey & Pierce, PLC

(57) ABSTRACT

An apparatus for providing a secondary source of water upstream of a standard flushometer-type valve. The adapter comprises a water inlet, a primary outlet for supplying water to the flush valve and respectively to the toilet, and a secondary outlet for providing a source of water which may be used to rinse out bed pans in the vicinity of the toilet. The water flow to the secondary outlet is independent of that to the primary outlet, providing for less waste of water during use of the secondary source.

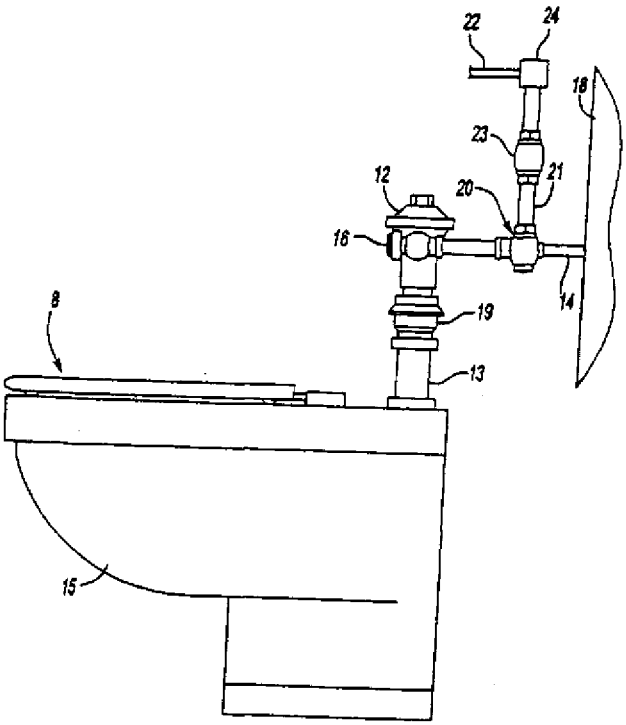

8 Claims, 2 Drawing Sheets